US006978567B1

(12) United States Patent
Pearsall

(10) Patent No.: US 6,978,567 B1
(45) Date of Patent: Dec. 27, 2005

(54) DOOR MOUNTED PENDANT DISPLAY

(76) Inventor: Janice J. Pearsall, 450 Flat Top Mountain Rd., Fairview, NC (US) 28730

( * ) Notice: Subject to any disclaimer, the term of this patent is extended or adjusted under 35 U.S.C. 154(b) by 10 days.

(21) Appl. No.: 10/826,033

(22) Filed: Apr. 19, 2004

(51) Int. Cl.[7] ..... G09F 3/16
(52) U.S. Cl. ..... 40/666
(58) Field of Search ..... 40/666, 591, 606.15, 40/607.1; 116/173; 248/534, 538, 539; 52/598

(56) References Cited

U.S. PATENT DOCUMENTS 3,540,406 A * 11/1970 Dexter ..... 116/28 R
3,695,256 A * 10/1972 Brower ..... 602/32
3,762,360 A * 10/1973 Hawes ..... 116/28 R
3,967,575 A * 7/1976 Coutts ..... 116/35 A
4,829,687 A * 5/1989 Rumpf ..... 40/606.15
5,233,938 A * 8/1993 Lalo ..... 116/173
5,483,916 A * 1/1996 Kolvites et al. ..... 116/173
5,899,167 A * 5/1999 Furman ..... 116/173

* cited by examiner

*Primary Examiner*—Lesley D. Morris
*Assistant Examiner*—Paul Royal, Jr.
(74) *Attorney, Agent, or Firm*—Mills Law Firm PLLC

(57) ABSTRACT

A pendant display includes a hanger slidably disposed over an inwardly pivoting door and having a holder at an outwardly facing end supporting a pole at a snap-fit ball and socket connection that is pivotal to a horizontal position for displaying into an adjacent hallway an attribute of the room or the adjacent vicinity.

4 Claims, 5 Drawing Sheets

FIG. 4
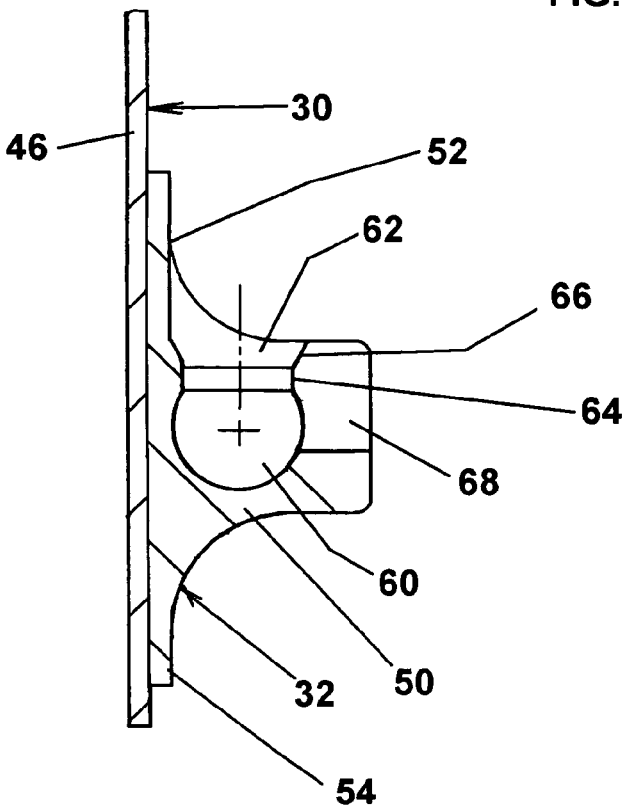
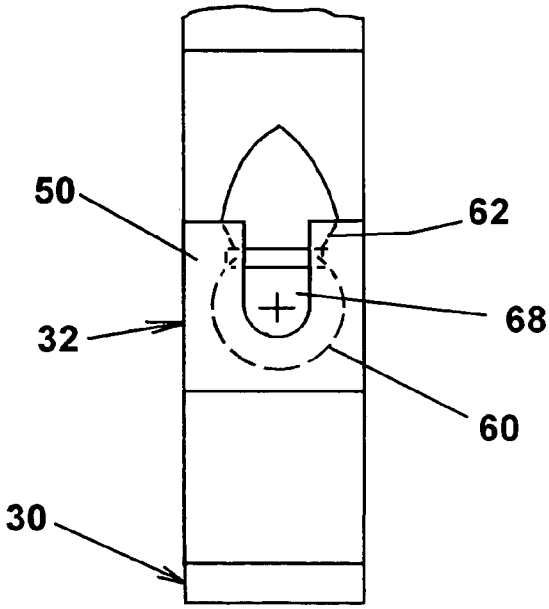
FIG. 5

DOOR MOUNTED PENDANT DISPLAY

FIELD OF THE INVENTION

The present invention relates generally to devices for displaying informational messages, and in particular, to a pendant holder that may be releasably mounted on inwardly pivoting doors to displaying information into adjoining spaces regarding attributes of room behind or in the vicinity of the door.

BACKGROUND OF THE INVENTION

It is increasingly common for business meetings, social events and like activities to be held off-site at business centers, hotels and motels. While large dedicated meeting rooms may include provisions for signage to designate the activity, small groups oftentimes use smaller rooms where identification is the responsibility of the user. The user is limited in the ways information can be attached or displayed. Mechanical fasteners, adhesives, or other attachments that would mar or disfigure the owner's property are prohibited or pose a potential liability problem to the group. Additionally, the sign information is generally limited to printed or handwritten text in a restricted format devoid of artistic or graphic content.

Accordingly, it would be desirable to provide an information display regarding attributes of a room that could be readily mounted without fixed attachments and graphically and artistically customized for the users. It would be particularly desirable to provide the information in the form of pendants such as flags, pennants, banners, and the like thereby permitting a customized factual or fanciful presentation of information in an adjoining hallway.

BRIEF SUMMARY OF THE INVENTION

The present invention achieves the foregoing by providing a pendant display that may be releasably hung from a conventional inwardly pivoting door wherein the display includes a thin bracket that slips over the top of the door and permit normal opening and closing thereof. A pole holder is attached to the base and pivotally supports at a ball and socket connection a pendant support pole movable to a horizontal position extending into the adjoining hallway that carries a pendant such as a flag or banner customized to identify an attribute of the room or vicinity. After use, the display may be removed without damage to the door, and folded compactly for storage awaiting reuse.

DESCRIPTION OF THE DRAWINGS

The above and other features and advantages of the invention will become apparent upon reading the following detailed description taken in conjunction with the accompanying drawings in which:

FIG. 4 is an enlarged side cross section view of the pole holder with the pole removed;

FIG. 5 is a front view of the pole holder of FIG. 4;

DETAILED DESCRIPTION OF THE PREFERRED EMBODIMENTS

Figure 1:
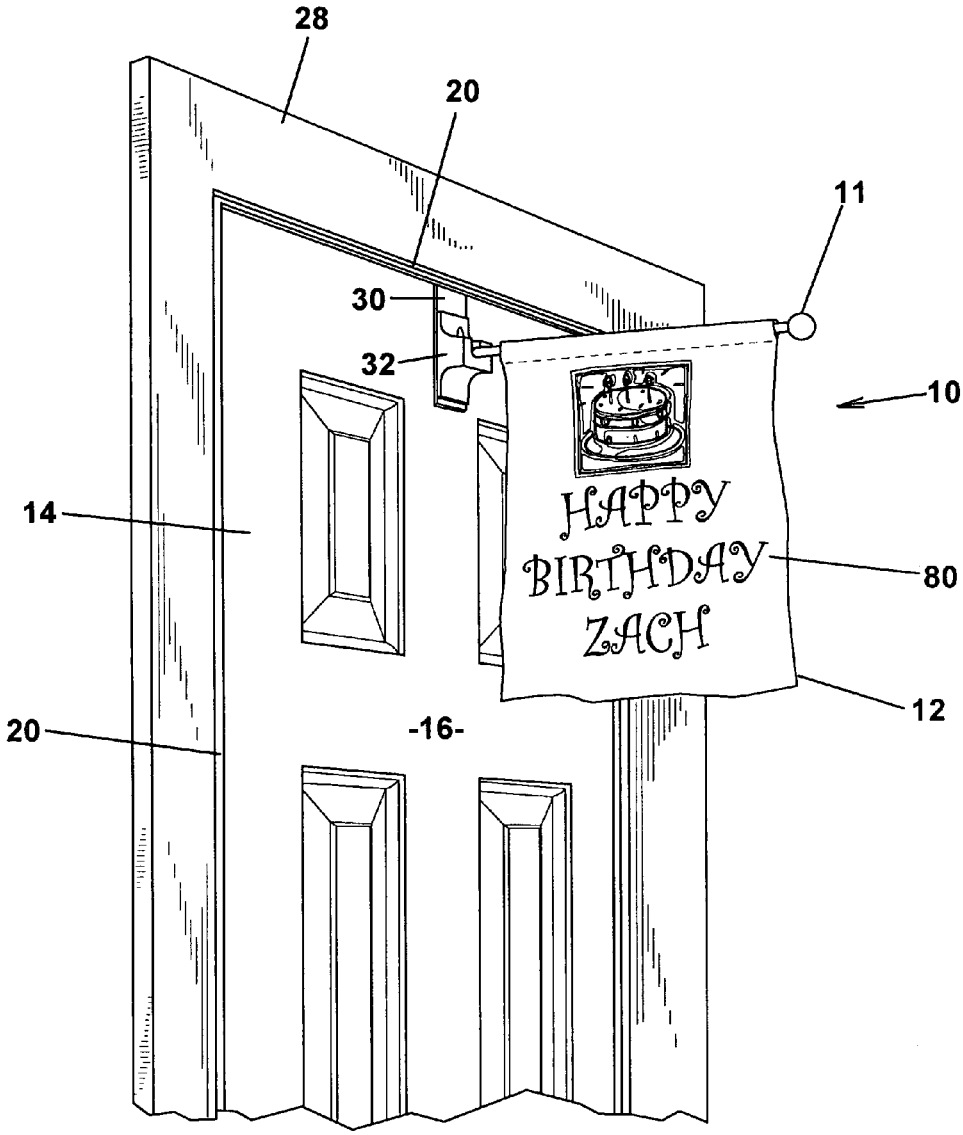
FIG. 1 is a front perspective view of a pendant display mounted on a door according to an embodiment of the invention.

Referring to the drawings, FIG. 1 shows a pendant display 10 having a pole 11 carrying a pendant 12 and supported from the top of an inwardly pivoting door 14 and overlying the upper exterior surface 16 thereof thereby displaying the pendant into an adjoining hallway while permitting normal opening and closing of the door. The door 14 is conventionally mounted in a door casing 18. The casing 18 is surrounded on the sides and top by stop moldings 20 rearwardly terminating adjacent the exterior surface 16. The display 10 as described below is adapted for hanging within the normal clearance space between the door, and the casing and stop molding.

Figure 2:
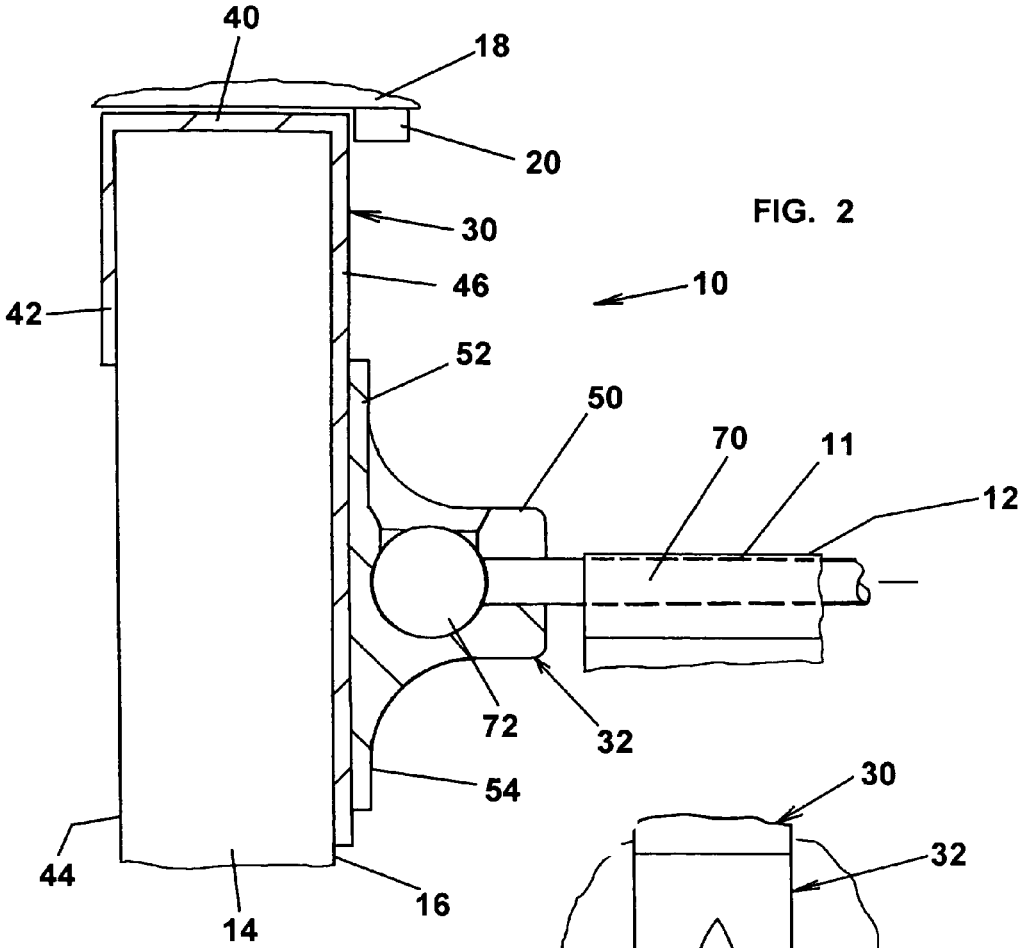
FIG. 2 is an enlarged side cross sectional view of the pendant display of FIG. 1.
Figure 3:
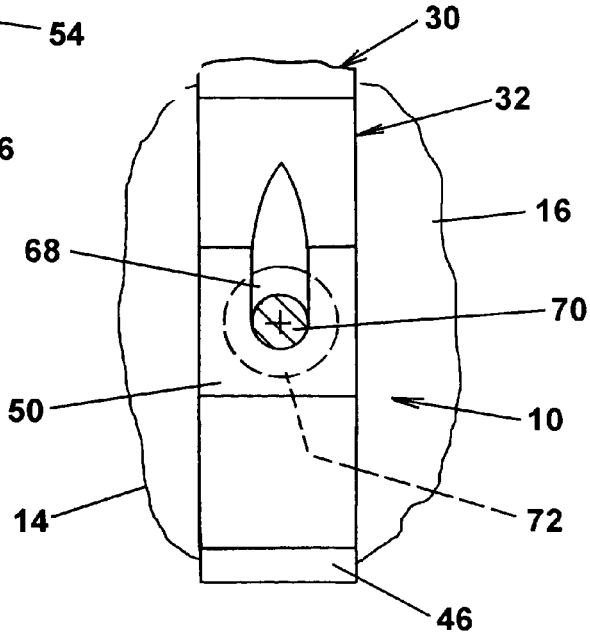
FIG. 3 is a front view of the pendant display shown in FIG. 1.

The pendant display 10 includes a hanger 30 having a pole holder 32 connected at the lower end thereof that carries the horizontally disposed pole 11 from which the pendant 12 is vertically suspended. Referring to FIGS. 2 through 3, the hanger 30 is a generally inverted U-shaped plastic strip having a top section 40 engaging the top surface of the door 14, a rear section 42 slidably engaging the interior surface 44 of the door 14, and a front section 46 slidably engaging the exterior surface 16 of the door 16. The hanger 30 has a thickness less than the clearances with the casing and stop molding so as not to interfere with normal movement of the door. The plastic for the holder is selected to limit surface damage to the door during mounting and removal.

As shown in FIGS. 4 and 5, the pole holder 32 is a one-piece plastic molding and includes a central base 50 with upwardly curved upper and lower arms, 52, 54 respectively. The pole holder 32 has a planar rear surface that is mechanically or adhesively attached to the outer surface of the front section 46 of the hanger 30. A spherical socket 60 is formed centrally in the base 50 and intersected by a pole insertion hole 62 formed vertically from the top surface of the base 50. The insertion hole 62 is defined by an inwardly extending annular retaining ring 64 and an outwardly flaring frustoconical lip 66. The inner diameter of the retaining ring 64 has a slightly smaller diameter than the socket 60 for retaining in assembly the inner end of the pole with a snap-fit as described below. The ring 64 may be continuous or a circumferential set of inwardly extending surfaces for providing the desired retention strength. A frontally upwardly opening U-shaped slot 68 is formed in the base 32 intersecting the socket 60. The slot 68 and a semicircular base having an axis coincident with the center of the socket 60 thereby providing a support and indexing surface for the shaft of the pole 70 in a horizontal deployed position.

Figure 6:
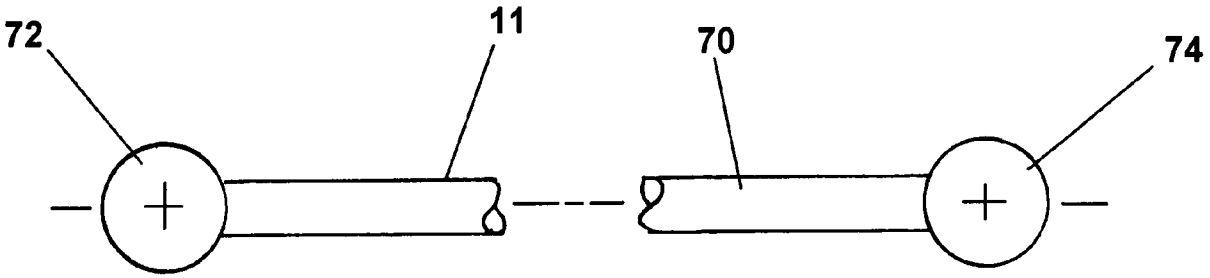
FIG. 6 is a side view of the pendant pole.
Figure 7:
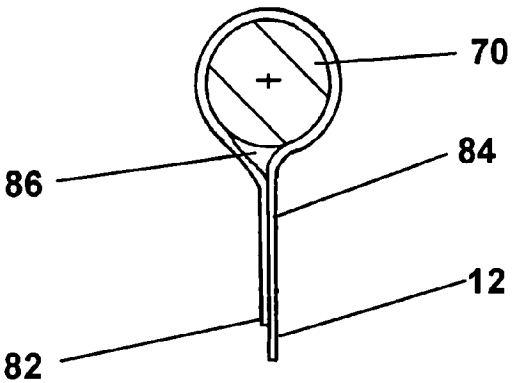
FIG. 7 is a cross sectional view of the pendant hanging on the pole.

Referring to FIG. 6, the pole 34 includes a center cylindrical shaft 70 and spherical end caps 72, 74. The inner end cap 72 has a diameter providing a sliding fit with the mating surface of the socket 60. The shaft 70 has a diameter having a sliding fit with the side surfaces of the slot 68 and a nesting fit with the end thereof. The shaft 70 has an extended length of about 6 to 18 inches, depending on the size of the pendant. The pole 11 is preferably a one-piece plastic molding.

The pole 11 is assembled to the holder 30 by aligning the shaft 70 with the insertion hole 62 and with the rear end cap 72 engaging the lip 66. By exerting downward force, the holder 30 has sufficient elasticity to allow the cap 72 to expand the retaining ring 66 and seat in the socket 60, with the ring retracting to capture the end cap 72 thereby providing a snap-fit assembly. After assembly, the pole may be rotated downwardly within the slot 68 to a horizontal display position. The pole may be returned to the vertical position for storage or inactivating the legend on the pendant.

The pendant 12 may take the form of a flag, banner, pennant, poster or like depending sheet like material. The pendant 12 bears a legend 80 depicting an attribute of the room beyond the door 14 or the vicinity therearound, by name, organization, function or other written or graphic information. The pendant may take various forms including the illustrated rectangular, triangular or irregular. To facilitate insertion and removal from the pole 34, the upper end of the pendant 12 is reversely folded and the flap 82 secured to the main panel 84 by suitable means to establish an elongated pocket 86 through which the ball cap 74 and shaft 70 of the pole are received.

It will be appreciated that many legends may be used to denote attributes of the room or vicinity in commercial or residential settings such as children's names, organizational names, meeting room activities, contents or conditions, or the like. The legend may be preprinted or customized as desired.

Figure 8:
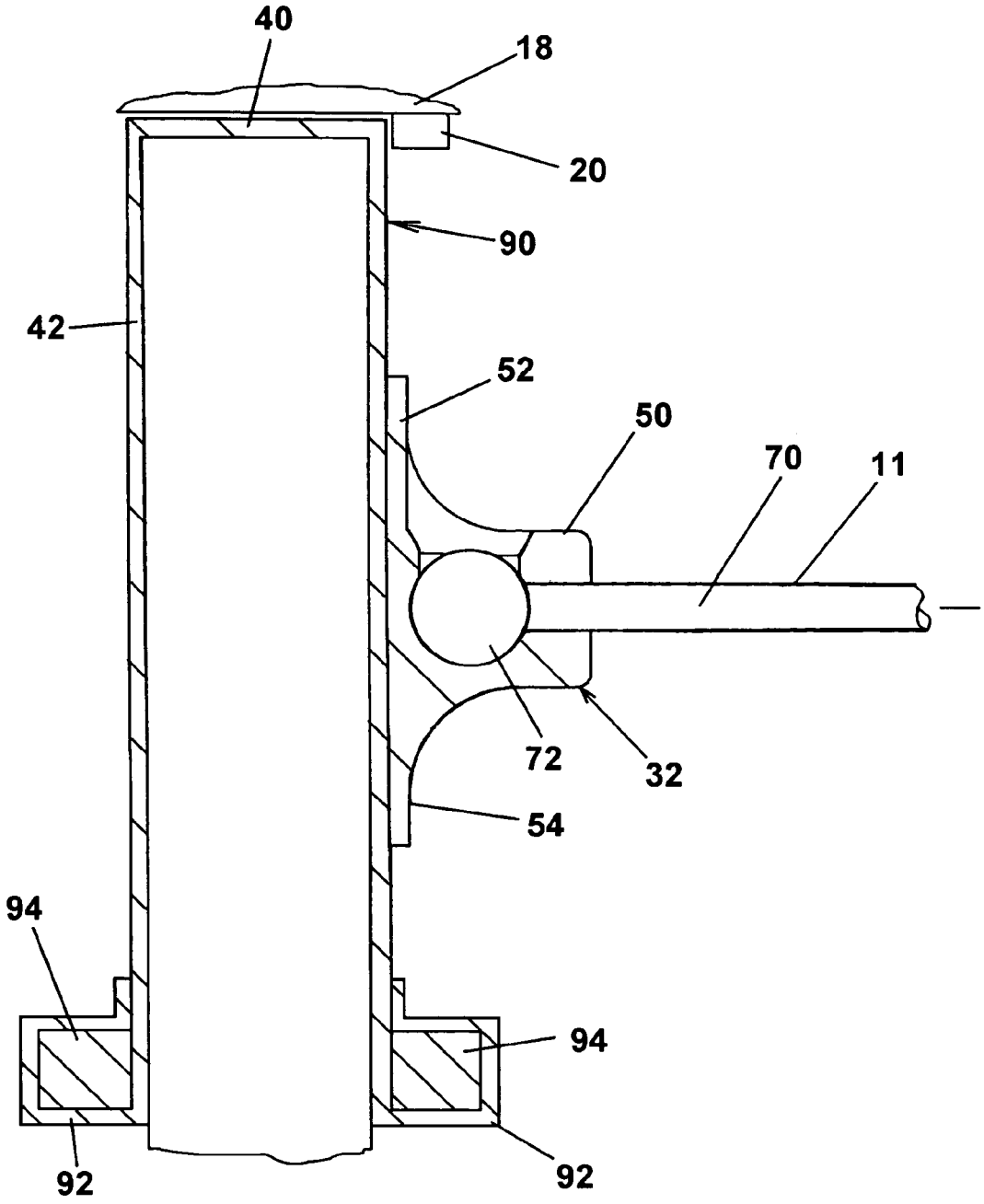
FIG. 8 is a side view of another embodiment of the pendant display.

FIG. 8 illustrates another embodiment of the invention wherein the hanger is in the form of a flexible weighted woven strap 90 draped over the top of the door 14. The holder 30, as described above, is adhesively or mechanically attached to the front panel of the strap. The ends of the front and real panels are provided with a stitched pocket 92 in which a weighted material, in solid or granular form, is received to provide sufficient weight to resist movement on the door and sufficient tension in the strap to support the holder with the pole in the horizontal display position.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed is:

1. In combination with a door assembly having an inwardly pivoting door mounting in a casing assembly between a room area and a hallway area, said door having spaced interior and exterior surfaces and a horizontal top surface wherein a limited clearance space is provided between the top and exterior surfaces and the casing assembly, a folding pendant display comprising: an inverted U-shaped hanger member having a thickness less than said limited clearance space, said hanger member having an upper section engaging the top surface of the door and spaced front and rear sections slidably overlying the exterior and interior surfaces of the door; a support holder formed of a single piece of plastic having a planar rear surface attached to said front section of said hanger member below the adjacent casing assembly whereby the door may be opened and closed with the hanger member and support holder thereon, a spherical socket formed in said support holder, a downwardly extending insertion aperture formed vertically in said support holder and intersecting said socket along a vertical insertion position; a pendant pole having an elongate cylindrical shaft and spherical ball member formed at one end thereof, said ball member being inserted through said aperture at said vertical insertion position and universally supported at said socket; snap fitting means integrally formed on said support holder adjacent said socket for receiving and retaining said ball member with a snap-fit; a pendant member having an upper end suspended by said shaft a vertically upwardly and forwardly opening slot formed in said holder and registering with said socket for accommodating pivotal movement of said pole from said vertical insertion position to a horizontal position for displaying said pendant in said adjoining hallway area.

2. The pendant display as recited in claim 1 wherein said hanger member is an inverted U-shaped thin wall plastic strip having spaced front and rear surfaces slidably disposed over the exterior and interior surfaces of the door.

3. The pendant display as recited in claim 2 wherein said pendant member is formed of a flexible sheet having an upper pocket formed therein trough which said shaft is received.

4. The pendant display as recited in claim 3 wherein said shaft has an enlarged other end for retaining said pendant member thereon.

* * * * *